US006092346A

United States Patent [19]

Even et al.

[11] Patent Number: 6,092,346

[45] Date of Patent: Jul. 25, 2000

[54] METHOD FOR CONNECTING A SHEET PILE TO A BEAM

[75] Inventors: Boris Even, Contern; Joseph Neu, Pontpierre; Marco Mascarin, Riehen; Charles Reinard, Esch-sur-Alzette, all of Luxembourg

[73] Assignee: ProfilARBED S.A., Esch-sur-Alzette, Luxembourg, Luxembourg

[21] Appl. No.: 09/172,826

[22] Filed: Oct. 15, 1998

Related U.S. Application Data

[63] Continuation of application No. PCT/EP97/01439, Mar. 21, 1997, abandoned.

[30] Foreign Application Priority Data

Apr. 17, 1996 [LU] Luxembourg ..... 88 743

[51] Int. Cl.[7] ..... E04C 3/30

[52] U.S. Cl. ..... 52/579; 52/584.1; 52/588.1; 52/463; 403/363; 405/250; 405/251; 405/274; 405/278; 405/281

[58] Field of Search ..... 52/579, 566.1, 52/584.1, 463, 472; 405/231, 232, 250, 251, 274, 277, 276, 278, 279, 281, 70, 72; 403/335, 340, 363

[56] References Cited

U.S. PATENT DOCUMENTS

| | | | |
|---|---|---|---|
| 1,851,864 | 3/1932 | Nolte . | |
| 3,848,417 | 11/1974 | Smith et al. | 61/1 F |
| 4,155,664 | 5/1979 | Acheson | 403/317 |
| 4,295,756 | 10/1981 | Blair | 405/70 |
| 4,367,979 | 1/1983 | Milligan | 405/70 |
| 5,163,785 | 11/1992 | Zanelli et al. | 405/277 |
| 5,292,208 | 3/1994 | Berger | 405/281 |
| 5,509,756 | 4/1996 | Chou et al. | 405/70 |
| 5,520,487 | 5/1996 | Decker | 405/278 |

FOREIGN PATENT DOCUMENTS

| | | | |
|---|---|---|---|
| 869950 | 12/1978 | Belgium . | |
| 0 072 118 | 2/1983 | European Pat. Off. | E02D 5/04 |
| 606861 | 6/1926 | France . | |
| 92 00 021 U | 2/1992 | Germany | E02D 5/08 |

*Primary Examiner*—Carl D. Friedman
*Assistant Examiner*—Yvonne M. Horton
*Attorney, Agent, or Firm*—Chapman & Cutler

[57] ABSTRACT

A method for connecting a standard sheet pile equipped with a standard locking element to the flange of a standard girder (31). First the initially flat edge (39) of the flange of the girder (31) is given an undulating profile having of a longitudinal series of bosses (40,42) cantilevered with respect to the flange of the girder (31). Next a connecting profile (30) including an inwardly flaring groove (36) is slotted onto the undulated edge so that the cantilevered bosses (40,42) can fit into said groove (36) and laterally lock the connecting section (30) on the undulated edge. The connecting section (30) being used is a hybrid profile which includes on the opposite side to the groove (36) a standard locking element (34) complementary to the standard locking element of the sheet pile. Into this locking element (34) is interlocked the standard locking element of the sheet pile to form a standard sheet pile joint therebetween.

19 Claims, 2 Drawing Sheets

METHOD FOR CONNECTING A SHEET PILE TO A BEAM

This is a continuation of International Application PCT/EP97/01439, with an international filing date of Mar. 21, 1997, now abandoned.

FIELD OF INVENTION

The present invention relates to a method for connecting a sheet pile to a beam, particularly with the aim of forming a combined supporting wall.

DESCRIPTION OF THE RELATED ART

Combined supporting walls, comprising metallic beams as the bearing elements and metallic sheet piles as intermediate sections intended to hold back the soil, have been known for a long time. They have the advantage of possessing very high section modules.

ProfilARBED S.A. (Luxembourg) markets an integrated system known as "HZ Combined Walls" for producing combined supporting walls. This system comprises special beams, called HZ beams, special Z-shaped sheet piles, called intermediate ZH sheet piles, and connecting sections, called RH connections. The flanges of the HZ beams have a shaped edge characterized by a shoulder of roughly triangular section protruding from the flange. These shaped edges are formed during the rolling of the HZ beams. The intermediate ZH sheet piles do not have the standard sheet pile interlocking elements, but each of the two flanges has a shaped edge similar to the shaped edges of the flanges of the HZ beams. The RH connection is provided with two grooves, symmetrical to each other, which widen from the outside to the inside of the connecting section, so that each defines a chamber complementary to the shaped edges of the flanges of the HZ beams and the ZH sheet piles. The rolled shoulders of the HZ beams and the ZH sheet piles ensure lateral locking of the flange edges in the grooves of the RH connection. The "HZ Combined Walls" integrated system has the disadvantage that it requires a program for rolling special beams and sheet piles. From the economic point of view, it would be more attractive to be able to produce combined supporting walls with beams and sheet piles from the standard program.

Combined supporting walls produced using beams and sheet piles from the standard program are known from the patent application EP-A-0072118. The beams used as bearing beams are driven into the ground, the flange edges to which a sheet pile will have to be connected are subjected to cold-forming so as to give these initially straight edges an undulating longitudinal profile. This undulating profile is characterized by a succession of bulges protruding with respect to the undeformed flange. The sheet pile connected to the flange is in fact a half sheet pile, obtained by cutting a standard U-shaped sheet pile longitudinally into two symmetrical parts. This half sheet pile then comprises a first longitudinal edge provided with a standard sheet pile interlocking element and a second flat longitudinal edge, i.e. not shaped. This second longitudinal edge is subjected to cold-forming so as to give it an undulating shape similar to that of the beam. To connect the deformed edge of the sheet pile to the deformed edge of a beam flange, a connecting section is used which is provided with two grooves that are symmetrical with respect to each other. These grooves widen from the outside to the inside of the connecting section so as to form chambers in which the bulges of the edge of the beam flange and of the edge of the half sheet pile produce—by a wedge effect—the lateral locking of these edges. It should be particularly emphasized that this connecting system, also known by the term "crimping", was described as long ago as 1934 in the patent DE 593825 for the assembly of sheet piles without interlocking elements.

It is important to note that the practical production of the combined supporting walls described in the patent application EP-A-0072118 is rather problematic. In fact, driving in a half sheet pile by ramming is a very uncertain if not impossible operation, in view of the low rigidity of the half sheet pile and the rudimentary guidance of the cold-formed edge of the sheet pile into the connecting section fixed to the flange of the pile. The risks of becoming unhooked, of locking and/or of deformations of the half sheet pile while it is being driven in are consequently very high. Moreover, the use of half sheet piles not only substantially reduces on-site efficiency, but also reduces the imperviousness of the wall by increasing the number of joints per running meter of wall. The use of U-shaped connecting half sheet piles also leads to an unfavorable arrangement of the sheet pile joints in the intermediate wall and also has a deleterious effect on the section modules of this wall.

The sheet piles used to produce homogeneous supporting walls, i.e. consisting exclusively of sheet piles, are provided with interlocking elements mainly optimized so that they slide easily in one another during the pile-driving, so as to ensure that they are sufficiently locked together even in cases of unavoidable torsional forces, so that they become interlocked in such a way as to transmit forces of thrust, traction and shear into the wall and so that they provide suitable imperviousness. The most familiar interlocking elements of standard sheet piles are "LARSSEN" type interlocking elements. These "LARSSEN" type interlocking elements are formed by the interlocking of two similar interlocking elements, producing a mutual attachment with a large overlap. Since their creation in 1902, "LARSSEN" type interlocking elements have continued to demonstrate their effectiveness in numerous applications throughout the world. In a combined supporting wall, it would therefore be desirable to be able to produce a joint similar to a standard sheet pile joint, particularly a "LARSSEN" type joint, between an intermediate sheet pile and a beam being used as a pile.

To solve this problem, the document DE-U-9200021 proposes to weld a "LARSSEN" type interlocking element along the edge of the beam flange, to which the sheet pile will have to be connected. The "LARSSEN" type interlocking element is welded to the beam flange either using a continuous welded joint on one side of the flange and a discontinuous welded joint on the other side of the flange, or using two continuous welded joints. It is clear that producing these welded joints is an expensive operation. In addition, the welded joints, which are necessarily not as thick as the beam and sheet pile flanges, form the weakest links of a combined supporting wall. In fact, when supporting walls are exposed to corrosion and/or to difficult pile-driving conditions, it is these welded joints which weakens soonest. So that, when the welded joint between the "LARSSEN" type interlocking element and the beam flange yields, the continuity of the wall is broken. As a result, the reliability of the method recommended in the document DE-U-9200021 is judged insufficient for many applications.

SUMMARY OF THE INVENTION

A problem forming the basis of the present invention is finally to propose an economic method for reliably connecting a standard sheet pile provided with a standard interlocking element, such as a "LARSSEN" type interlocking element, to a flange of a standard beam.

This problem is solved by the method according to claim 1. In the first place, an initially flat edge of the flange of a standard beam is given an undulating profile comprising a longitudinal succession of bulges protruding from the flange. A connecting section, incorporating a groove which widens from the outside to the inside, is slid over the edge prepared in this way, so that the said protruding bulges can be received into the said groove and can lock the hybrid connecting section laterally on to the undulating edge. According to the invention, the hybrid connecting section comprises, on the side opposite the said groove, a standard interlocking element complementary to the said standard interlocking element of the sheet pile. It then only remains to interlock the standard interlocking element of the sheet pile into the said interlocking element of the connecting section attached to the beam to form a standard sheet pile joint. Compared with the welded connection described in the document DE-U-9200021, the connection produced by the present method has in particular a much smaller risk of rupture when the supporting wall is exposed to corrosion and/or to difficult pile-driving conditions. Compared with the connections described in the patent application EP-A-0072118, the connection produced by the present method has many advantages, for example:

- the possibility of connecting a complete standard sheet pile to the beam, with a resultant better on-site efficiency, fewer joints per running meter of the wall and a higher section modulus for this wall;
- better guidance of the sheet pile in the interlocking element of the hybrid connecting section during pile driving; and
- the possibility of adjusting, at the level of the sheet pile joints, any defects of alignment of the beams in the combined wall because of the play allowed in the interlocking elements of the sheet piles.

If this method is used in a combined supporting wall to connect a standard sheet pile fitted with a standard interlocking element to a flange of a beam, the following steps are carried out after the said connecting section has been slid over the said undulating edge:

- the connecting section is locked in a longitudinal direction with respect to the flange of the beam,
- the beam prepared in this way is partially (or almost completely) driven into the ground,
- the said standard interlocking element of the sheet pile is interlocked into the said interlocking element of the connecting section and the sheet pile is driven into the ground to form a standard sheet pile joint.

It would be possible to give the edge of the beam an undulating profile comprising a succession of bulges all protruding from the same face of the flange. However, it is more advantageous to give the edge of the beam a succession of bulges protruding alternately from the two faces of the flange. The groove in the connecting section which receives these bulges may then have a plane of symmetry so that the connecting section can be turned through 180° for mounting in two different positions on the undulating edge, which increases the flexibility with which the connecting section can be used.

The standard interlocking element of the connecting section and the standard interlocking element of the sheet pile both advantageously comprise a hook-shaped element, and an abutment surface positioned opposite the hook. The said abutment surface defines with the hook a slit-shaped aperture giving access to an inner chamber of the hook, into which is housed the head of a hook (generally called a "ridge") of the complementary interlocking element. A preferred type of connecting section also incorporates a body with a C-shaped transverse cross-section which defines the groove making it possible to receive the undulating edge of the beam flange. The hook-shaped element is positioned on this C-shaped body so that the back of the "C" defines the said abutment surface.

In the preferred type of connecting section, the hook is positioned at a distance "z" from the plane of symmetry of the groove. This distance "z" is roughly equal to half the width of the hook-shaped element less half the thickness of that element. This ingenious arrangement makes it possible to ensure, for a standard Z-shaped sheet pile connected to two beams on either side of the sheet pile, that the faces of the flange are coplanar and parallel to the beam flanges, while using only a single type of connecting section.

Preferably, the sheet piles used to form the combined supporting wall are Z-shaped sheet piles provided with "LARSSEN" type interlocking elements. However, application of the method with other types of sheet pile interlocking element is not ruled out, provided the following requirements are satisfied:

1) the interlocking elements must be capable of interlocking with each other with enough play to enable them to slide easily over each other;
2) the configuration of the interlocking elements must be such that, in spite of this play:
   sufficient guidance is maintained during pile-driving;
   the interlocking is sufficiently robust even in cases of unavoidable torsional forces;
3) the interlocking elements must become interlocked so that the forces of thrust, traction or shear to be taken up by the sheet piles in a supporting wall can be transmitted through the joints.

BRIEF DESCRIPTION OF THE DRAWINGS

The method according to the invention and some of its advantages are illustrated with the help of the appended drawing which.

DESCRIPTION OF THE PREFERRED EMBODIMENTS

Figure 1A:
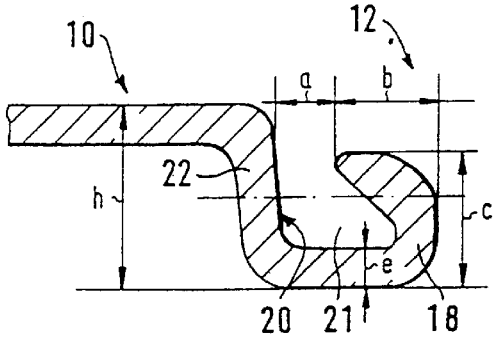
FIGS. 1A and 1B are transverse cross-sections through the "LARSSEN" type interlocking elements of standard Z-shaped sheet piles.
Figure 1B:
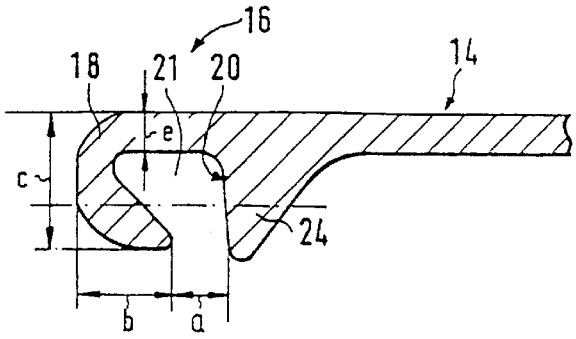

FIG. 1A shows a flange 10 of a Z-shaped sheet pile at the end of which there is a first standard "LARSSEN" type interlocking element, denoted by the arrow 12. FIG. 1B shows a flange 14 of a Z-shaped sheet pile at the end of which there is a second standard "LARSSEN" type interlocking element, denoted by the arrow 16. These interlocking elements 12 and 16 both incorporate a longitudinal edge 18 curved in such a way as to have a transverse cross-section corresponding roughly to that of a J-shaped hook. This curved edge 18, called for simplicity "hook 18", is opposite an abutment surface 20 and with the said surface defines a slit-shaped aperture of width "a" giving access to an inner chamber 21 of the hook 18. It should be noted that this width "a" is substantially smaller than the width "b" of the head of the hook 18, generally called a ridge, which is received into the inner chamber 21 during the interlocking of the two interlocking elements.

The hooks 18 of the interlocking elements in FIGS. 1A and 1B have roughly the same geometry. However, in the case of FIG. 1A, the abutment surface 20 is formed by a bend 22 in the flange 10, whereas in the case of FIG. 1B the abutment surface 20 is formed by a ridge 24 on the flange 14. The interlocking element 12 will be called a "bent" interlocking element and the interlocking element 16 will be called a "straight" interlocking element.

The height "h" of the bend 22 in the bent interlocking element 12 is defined as follows:

$$h=c+e+j \quad (1)$$

wherein c=width of the hook 18; e=thickness of the hook in the part parallel to the flange; i=the interlock play perpendicular to the flange.

The fact that the bend 22 has a height "h" defined in this way guarantees that the outer faces 10' and 14' of the flanges 10 and 14 are roughly coplanar when the two interlocking elements 12 and 16 are interlocked.

Figure 3:
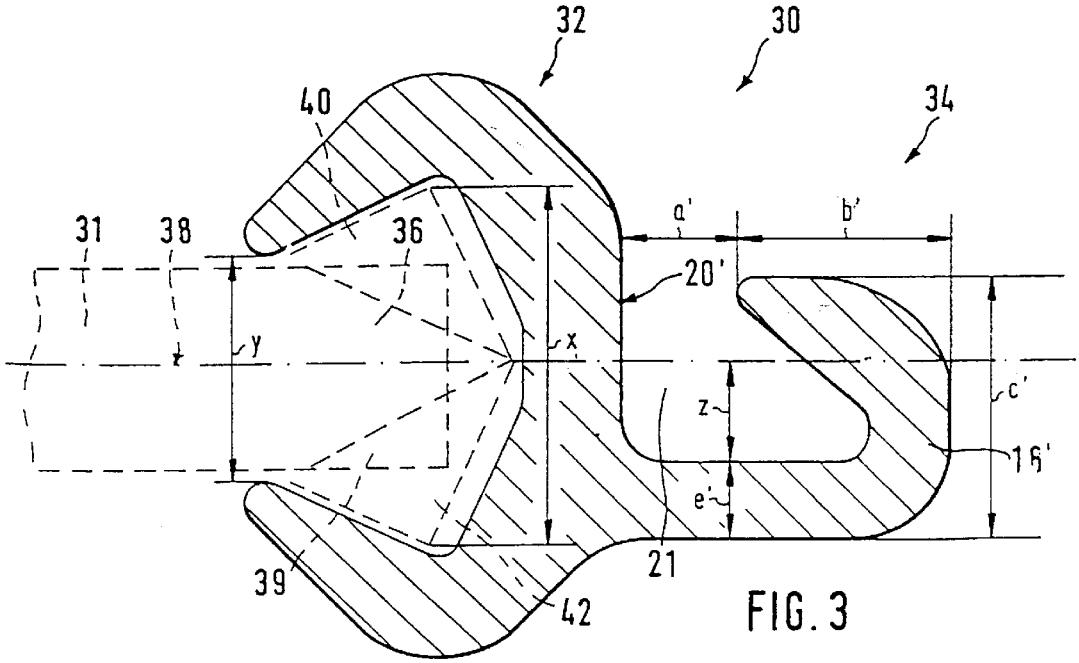
FIG. 3 is a transverse cross-section through a preferred way of producing a connecting section connected to a beam flange.

A preferred way of producing a connecting section 30, designed to connect the sheet pile flange 10, 14 to one end of a beam flange 31, is shown in FIG. 3 (the end of the beam flange 31 is drawn in dotted lines). The connecting section 30 is a hybrid section comprising, on one side, a body 32 having a roughly C-shaped cross-section and, on the other side, a standard "LARSSEN" type interlocking element 34.

The body 32 is designed so that it can slide longitudinally over the edge 39 of the end of the beam flange 31. This edge 39 has been subjected to cold forming so as to have an undulating longitudinal profile characterized by a succession of bulges 40, 42 oriented alternately towards the two sides of the flange. In order to receive the undulating edge, the body 32 defines a groove 36 (see also FIGS. 2A and 2B) which widens from the outside to In. the inside in a manner that is symmetrical with respect to a plane 38 (hereinafter called the symmetry plane of the groove 36). When the hybrid connecting section 30 is made to slide longitudinally over the deformed edge of the beam flange 31, the bulges 40, 42 are received into the groove 30. It can be seen in FIG. 3 that the distance "x" between the line through the crests of the bulges 42 and the line through the crests of the bulges 40 is considerably greater than the width "y" of the aperture of the groove 36. The bulges 40 and 42 consequently ensure lateral locking of the hybrid connecting section 30 on to the beam flange 31.

Like the sheet pile interlocking elements 12, 16 described above, the standard interlocking element 34 of the connecting section 30 comprises a J-shaped curved edge acting as a hook 18', and an abutment surface 20'. The latter is formed by the back of the body 32 on which the hook 18' is positioned. The dimensions "a'", "b'" and "c'" correspond substantially to the dimensions "a", "b" and "c" of a "LARSSEN" type sheet pile interlocking element (see FIGS. 1A and 1B).

Figure 2A:
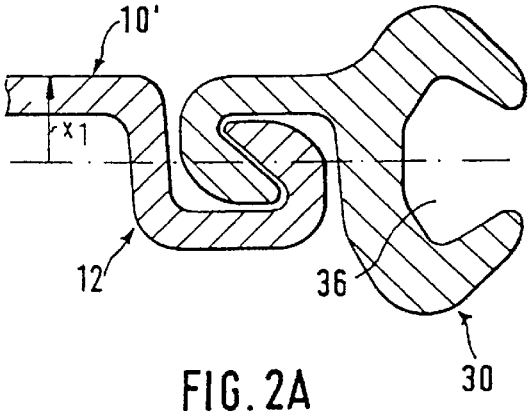
FIGS. 2A and 2B are transverse cross-sections through the interlocking elements of FIGS. 1A and 1B, interlocked in a preferred way of producing a connecting section.
Figure 2B:
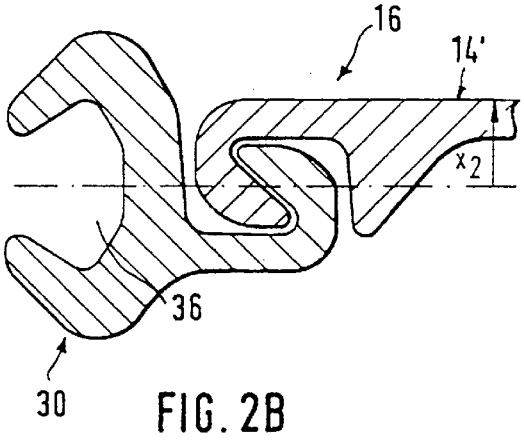

It should be noted that the hook 18' is located at distance "z" from the symmetry plane 38 of the groove 36. This distance "z" is determined in such a way that, in FIGS. 2A and 2B showing the interlocking elements 12 and 14 of FIGS. 1A and 1B interlocked in the standard "LARSSEN" type interlocking element 34 of the connecting section 30, the distances $x_1$ and $x_2$ are roughly equal. These distances $x_1$ and $x_2$ represent the distances of the outer faces 10' and 14' of the flanges 10 and 14 from the symmetry plane of the groove 36. It is easily shown that, in the case where the interlock play is neglected, this condition is satisfied if:

$$z=(c-e)/2 \quad (2)$$

wherein z is the distance between the symmetry plane 38 of the groove 36 and the bottom of the chamber 21'; c is the width of the sheet pile hook 18; e is the thickness of the sheet pile hook 18 in the part of it parallel to the flange.

Figure 5:
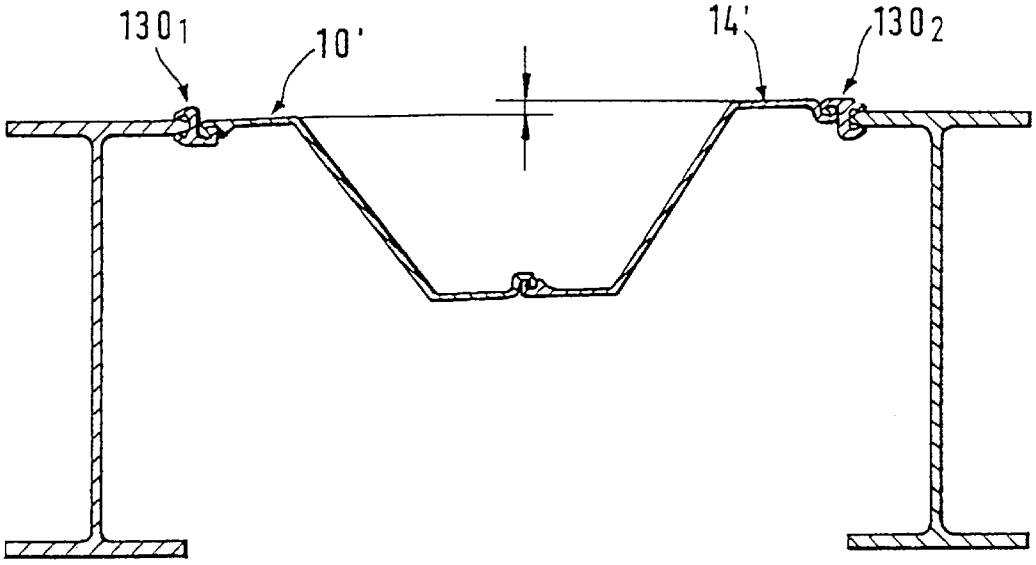
FIG. 5 is a transverse cross-section through one sector of a combined supporting wall, produced using a variant of the way of producing the connecting section.
Figure 4:
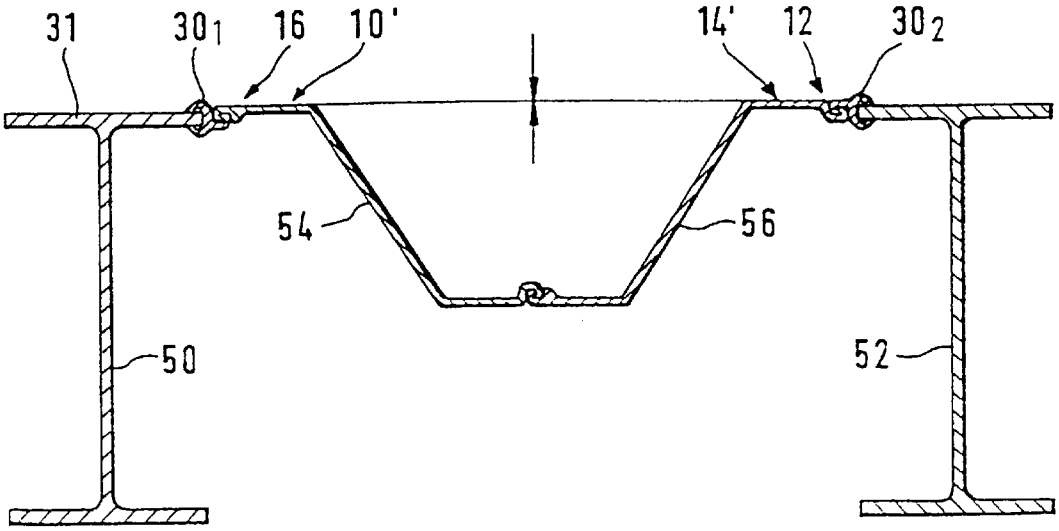
FIG. 4 is a transverse cross-section through one sector of a combined supporting wall, produced using the connecting section of FIG. 3.

The effect of this ingenious design of the connecting section 30 will be better understood by comparing FIGS. 4 and 5.

FIG. 4 shows one sector of a combined supporting wall produced using the connecting section of FIG. 3. The sector consists of two beams 50, 52 as bearing sections and two Z-shaped sheet piles 54, 56 as intermediate sections. The beam 50 carries a connecting section $\mathbf{30}_1$ according to FIG. 3, whose hook 18' has its aperture facing outwards. The beam 52 carries a connecting section $\mathbf{30}_2$ completely identical with the connecting section $\mathbf{30}_1$. However, the connecting section $\mathbf{30}_2$ has been rotated through 180° around its longitudinal axis, so that hook 18' has its aperture facing inwards. The interlocking element 34 of the connecting section $\mathbf{30}_1$ is interlocked in a straight interlocking element 16 of the sheet pile 54 (i.e. a interlocking element of the type shown in FIG. 1B). The interlocking element 34 of the connecting section $\mathbf{30}_2$ is interlocked in a bent interlocking element 12 of the sheet pile 56 (i.e. a interlocking element of the type shown in FIG. 1A). A close examination of FIG. 4 will reveal that, thanks to the ingenious positioning of the hook 18' on the connecting section 30, only a single type of connecting section is required to obtain flange faces 10', 14' coplanar and parallel to the two outer faces of the beam flanges.

FIG. 5 also shows one sector of a combined supporting wall. This sector incorporates connecting section $\mathbf{130}_1$ and $\mathbf{130}_2$, differing from those of FIG. 3. In the connecting sections $\mathbf{130}_1$ and $\mathbf{130}_2$, the distance "z" is not adhered to. As a result of this, the outer faces of the flanges 10', 14' are no longer parallel to the two outer faces of the beam flanges.

The joint between the sheet pile 54 and the beam 50 of the sector of supporting wall in FIG. 4 is advantageously produced as follows. After the initially flat edges of the flange 31 of the beam 50 have been given an undulating longitudinal profile consisting of a succession of bulges 40, 42 protruding from the flange 31, a connecting section 30 according to FIG. 3 is slid over this undulating edge. The connecting section is then locked in a longitudinal direction with respect to the beam flange in order to prevent axial displacement of the connecting section with respect to the beam flange while the beam and/or the sheet pile is being driven into the ground. This locking may for example be produced by welding. However, it is also possible to deform the connecting section at the position of the groove 36 so as to create longitudinal abutments in it behind the bulges 40, 42. The beam 50 prepared in this way can now be driven into the ground. The interlocking element 16 of the sheet pile 54 is interlocked into the interlocking element of the connecting section protruding from the ground and the sheet pile is driven into the ground (for example by pile-driving or by vibration).

It should be pointed out that the connecting sections 30 (or 130) could also be used to connect U-shaped sheet piles to the beams 50 and 52. If one or three U-shaped sheet piles are used between two beams, it would be necessary to turn the connecting section $\mathbf{30}_2$ through 180° so that its hook faces upwards.

What is claimed is:

1. Method for assembling a sheet pile and a beam, comprising following steps:

providing the sheet pile having a standard hook-type interlocking element;

providing the beam having a beam flange with an initially flat edge;

providing on said initially flat flange edge a longitudinal succession of bulges protruding with respect to said beam flange, so as to transform said initially flat flange edge in an undulating flange edge;

providing an asymmetric connection section incorporating on one side a groove which widens from outside to inside, and on a side opposite to the groove a standard hook-type interlocking element complementary to said standard hook-type interlocking element of said sheet pile;

sliding said connection section over said undulating flange edge, so that said protruding bulges are received in said groove with ability to lock the connection section laterally onto the undulating flange edge; and locking said standard hook-type interlocking element of said sheet pile with said hook-type interlocking element of said connection section to form a standard hook-type sheet pile joint.

2. Method according to claims 1, wherein said sheet pile is a Z-shaped sheet pile and said standard hook-type interlocking elements are "LARSSEN" type interlocking elements.

3. Method according to claim 1, wherein said beam flange is given an undulating profile with the longitudinal succession of bulges protruding alternately from two faces of the flange, and the groove has a plane of symmetry, so that the connection section can be turned through 180° to be mounted in two different positions onto said undulating flange edge, and wherein said standard hook-type interlocking element of said connection section is asymmetrical with regard to said plane of symmetry.

4. Method according to claim 3, wherein said standard hook-type interlocking element of the connection section and said standard hook-type interlocking element of the sheet pile both have an edge formed as a hook, and an abutment surface positioned opposite the hook and defining with said hook an opening to an inner chamber.

5. Method according to claim 4, wherein the connection section comprises a body which has a C-shaped transverse cross-section and which defines said groove, and said hook is positioned on this body in such a way that the back of the "C" defines said abutment surface.

6. Method according to claim 4, wherein the following condition is satisfied:

$$z=(c-e)/2$$

wherein z is the distance between said plane of symmetry of said groove and the bottom of said inner chamber; c is the width of said hook of said sheet pile; e is the thickness of the hook of said sheet pile in the part of it parallel to a sheet pile flange.

7. Method according to claim 6, wherein said sheet pile is a Z-shaped sheet pile and said standard hook-type interlocking elements are "LARSSEN" type interlocking elements.

8. Method according to claim 1, further comprising a step of welding said connection section received on said undulating flange edge to the latter.

9. Method according to claim 1, further comprising a step of mechanically deforming said connection section received on said undulating flange edge so as to create within said groove longitudinal abutments behind said bulges of said flange edge.

10. Method for erecting a supporting wall, comprising following steps:

providing a sheet pile having a standard hook-type interlocking element;

providing a beam having a beam flange with an initially flat flange edge;

providing on said initially flat flange edge a longitudinal succession of bulges protruding with respect to said beam flange so as to transform said initially flat flange edge in an undulating flange edge;

providing an asymmetric connection section incorporating on one side a groove which widens from the outside to the inside, and on a side opposite said groove a standard hook-type interlocking element complementary to said standard hook-type interlocking element of the sheet pile;

sliding the connection section over the undulating flange edge, so that said protruding bulges are received in said groove with ability to lock the connection section laterally onto said undulating flange edge;

locking said connection section in a longitudinal direction with respect to the beam flange;

driving the beam prepared in this way partially into a ground;

locking said standard hook-type interlocking element of the sheet pile into said standard hook-type interlocking element of the connection section;

driving said sheet pile into the ground to form a standard hook-type sheet pile joint between said sheet pile and said connection section; and repeating the above steps as often as necessary to erect a combined supporting wall.

11. Method according to claim 10, wherein said sheet pile is a Z-shaped sheet pile and said standard hook-type interlocking elements are "LARSSEN" hook-type interlocking elements.

12. Method according to claim 10, wherein said beam flange is given an undulating profile with the longitudinal succession of bulges protruding alternately from two faces of the flange, and the groove has a plane of symmetry, so that the connection section can be turned through 180° to be mounted in two different positions onto said undulating flange edge, and wherein said standard hook-type interlocking element of said connection section is asymmetrical with regard to said plane of symmetry.

13. Method according to claim 12, wherein said standard hook-type interlocking element of the connection section and said standard hook-type interlocking element of the sheet pile both have an edge formed as a hook, and an abutment surface positioned opposite said hook and defining with the hook an opening to an inner chamber.

14. Method according to claim 13, wherein the connecting section comprises a body which has a C-shaped transverse cross-section and which defines said groove, and said hook is positioned on this body in such a way that the back of the "C" defines said abutment surface.

15. Method according to claim 14, wherein the following condition is satisfied:

$$z=(c-e)/2$$

wherein z is the distance between said plane of symmetry of the groove and the bottom of said inner chamber; c is the width of the hook of said sheet pile; and e is the thickness of the hook of said sheet pile in the part of it parallel to a sheet pile flange.

16. Method according to claim 15, wherein said sheet pile is a Z-shaped sheet pile and said standard hook-type interlocking elements are "LARSSEN" type interlocking elements.

17. Method according to claim 10, wherein the locking of said connection section in the longitudinal direction with respect to said beam flange is provided by welding said connection section received on said undulating flange edge to the latter.

18. Method according to claim 10, wherein the locking of said connection section in the longitudinal direction with respect to said beam flange is provided by mechanically deforming said connecting section received on said undulating flange edge so as to create within the groove longitudinal abutments behind the bulges of said flange edge.

19. A section for connecting a flange of Z-shaped sheet pile having an interlocking hook forming either a standard bent LARSSEN type interlocking element or a standard straight LARSSEN type interlocking element to a beam flange, said section comprising:

on one side, a body having a C-shaped transverse cross-section, said body defining a groove adapted for receiving and interlocking an edge of said beam flange, said groove widening from outside to inside and having a plane of symmetry;

on the opposite side, an interlocking hook which is complementary to said LARSSEN type interlocking hook, said interlocking hook of the connection section being formed on said body so that the back of said C-shaped body defines with the hook an opening to an inner chamber; wherein the following condition is satisfied:

$$z=(c-e)/2$$

wherein z is the distance between said plane of symmetry of said groove and the bottom of said inner chamber;

c is the width of the hook of the sheet pile; and e is the thickness of the part of said hook of the sheet pile that is parallel to a sheet pile flange;

so that it is possible to use said section in a first position on said flange edge to connect the standard Z-shaped sheet pile with its bent LARSSEN type interlocking element to the beam flange, and to use said section turned through 180° in a second position on said flange for connecting the standard Z-shaped sheet pile with its straight LARSSEN type interlocking element to the beam flange, while ensuring in both cases that the outer face of the flange of the Z-shaped sheet pile lies substantially in the same plane.

* * * * *